US006600362B1

(12) United States Patent
Gavrila

(10) Patent No.: US 6,600,362 B1
(45) Date of Patent: Jul. 29, 2003

(54) METHOD AND CIRCUITS FOR PARALLEL SENSING OF CURRENT IN A FIELD EFFECT TRANSISTOR (FET)

(75) Inventor: Gabe C. Gavrila, Colorado Springs, CO (US)

(73) Assignee: Toko, Inc. (JP)

( * ) Notice: Subject to any disclaimer, the term of this patent is extended or adjusted under 35 U.S.C. 154(b) by 0 days.

(21) Appl. No.: 10/071,049

(22) Filed: Feb. 8, 2002

(51) Int. Cl.[7] ..... G05F 1/10
(52) U.S. Cl. ..... 327/541; 327/543; 327/427
(58) Field of Search ..... 327/427, 430, 327/431, 434, 538, 540, 541, 543; 323/315–316

(56) References Cited

U.S. PATENT DOCUMENTS 4,021,701 A 5/1977 Davies ..... 361/18
4,700,461 A * 10/1987 Choi et al. ..... 438/149
5,272,392 A 12/1993 Wong et al. ..... 327/109
5,867,015 A * 2/1999 Corsi et al. ..... 323/316
6,188,211 B1 * 2/2001 Rincon-Mora et al. ..... 323/280
6,285,246 B1 * 9/2001 Basu ..... 327/541

* cited by examiner

*Primary Examiner*—Terry D. Cunningham
*Assistant Examiner*—Long Nguyen
(74) *Attorney, Agent, or Firm*—William E. Hein

(57) ABSTRACT

A circuit for parallel sensing of the current in a power FET includes a sense FET and a current conveyor circuit employing exclusively FET devices. All FET devices may be MOSFET devices or JFET devices. The sense FET and the power FET have their gate terminals connected together and their source terminals connected together. The current conveyor circuit includes a current mirror. One or more additional current mirrors may be employed. One or more of the additional current mirrors may be cascoded or have other circuit techniques applied to them, in order to enhance their performance, hence overall circuit current sense performance.

4 Claims, 2 Drawing Sheets

METHOD AND CIRCUITS FOR PARALLEL SENSING OF CURRENT IN A FIELD EFFECT TRANSISTOR (FET)

BACKGROUND AND SUMMARY OF THE INVENTION

This invention relates generally to electronic systems and, more particularly, to electronic circuits, including integrated circuits, that require current sensing. In addition, the present invention relates to integrated circuit fabrication and, in particular, to a method for sensing the current in a field effect transistor (FET) device. Generally, FET devices can be classified as either junction field effect transistor (JFET) devices or metal oxide semiconductor field effect transistor (MOSFET) devices. The present invention applies to both JFET and MOSFET devices, as well as to hybrid circuits, assembled board circuits, and any other type of electrical circuit in which sensing of current in a FET device is performed. Circuits which require current sensing include voltage and current sources, voltage and current references, and various regulator circuits, among others.

Many prior art circuits employ means to control and limit the current flowing through their terminals, thus protecting the circuit itself, the load, or both, from the effects of, and possible damage resulting from, excessive current. Voltage sources and voltage regulators employing current limit protection are one example of such circuits. With the increasing use of smaller power supply voltages and battery operated systems and the advent of low dropout voltage regulators, the need to sense current in the power device, while minimizing peturbations to the system, becomes more important.

The most common way to sense current is to monitor the voltage drop across a current sense resistor, inserted in the current path. In accordance with Ohm's law, the voltage drop across the current sense resistor is directly proportional to the current flowing through that resistor. The current sense resistor may be replaced by any device or circuit with substantially resistive characteristics. However, this approach is disadvantageous in several respects. First, all of the output current, possibly large, flows through the sense device or circuit; resulting in undesired power loss and/or heat dissipation. Thus, the sense device or circuit must be capable of dissipating a large amount of power/heat, which increases its cost and size. Attempts to minimize power loss by minimizing the resistance of the sense device or circuit encountered difficulties in implementing and controlling those small resistances. In addition, the voltage drop across the sense device or circuit which is inserted in series with the load current path, is unacceptable in some applications, such as in low dropout (LDO) voltage regulators, for instance, and it is generally undesirable in any application.

The prior art is replete with attempted solutions to the current sensing problems discussed above. U.S. Pat. No. 4,021,701 teaches sensing the current in a bipolar transistor by means of a scaled down transistor, whose base and emitter are connected in parallel with the base and emitter terminals of the first transistor. The transistor whose current is evaluated is often called the power transistor. This scaled down transistor is often called the sense transistor because it is used to sense the current in the power transistor. This patent teaches that the power transistor and the sense transistor must be of the same type; that is, they must both be either npn transistors or pnp transistors. The power transistor and the sense transistor have common base terminals and common emitter terminals, so the emitter current flowing in the sense transistor is substantially proportional to the emitter current flowing in the power transistor. The proportionality factor depends, essentially, on the form factor ratio between the sense and power transistors. As a first approximation, this is the ratio of the emitter area of the sense transistor to the emitter area of the power transistor. The collector current in the sense transistor is approximately equal to its emitter current. If a resistor is connected in series with the collector of the sense transistor, a current that is essentially proportional to the current flowing in the power transistor will flow through it. Thus, the current that flows in the power device can be monitored, by observing the voltage drop across said resistor.

U.S. Pat. No. 5,272,392 teaches current sensing in the case of a MOSFET, by means of a smaller, scaled down MOSFET, which is referred to as the sense transistor or sense MOSFET. The sense transistor is of the same type, NMOS or PMOS, as the power MOSFET. The source and gate terminals of the sense transistor are connected to the source and gate terminals of the power transistor, respectively. As illustrated in FIG. 1, a resistor is connected between the drain terminal of the sense MOSFET and the drain terminal of the power MOSFET. Thus, a smaller current, substantially proportional to the current flowing in the power MOSFET, flows through the drain terminal of the sense MOSFET and hence through the resistor. The proportionality factor depends, essentially, on the scale factor between the sense MOSFET and the power MOSFET. The scale factor depends, as a first approximation, on the W/L ratios of the two transistors (FET channel width over channel length). According to Ohm's law, the resistor develops a voltage drop across itself, proportional to the current flowing through it. This current is, in turn, substantially proportional to the current flowing in the power MOSFET. The voltage drop across the resistor may thus be used as a measure of the current flowing in the power MOSFET, multiplied by a constant. At the same time, the voltage drop across the resistor represents the difference between the drain voltage of the power FET and the drain voltage of the sense FET. This causes the sense FET and the power FET to operate at different drain-to-source voltages, thus introducing an error in the current mirror effect. This error becomes more and more important, as the drain-to-source voltage becomes smaller.

Yet another approach to current sensing is disclosed in U.S. Pat. No. 5,867,015. This patent teaches current sensing in a MOSFET, which is herein referred to as the power MOSFET, by connecting in parallel the source and gate terminals, respectively, of a power MOSFET and of a smaller, scaled down MOSFET, which is herein referred to as the sense transistor or sense MOSFET. This prior art solution to current sensing, a circuit illustrated in the example of FIG. 2, eliminates the need for a sense resistor connected in series with the drain terminal of the sense MOSFET. Instead, the sense resistor is replaced with a circuit known as a current conveyor, consisting of components Q1, Q2, M3, M4. The first terminal, A, of the current conveyor circuit is connected to the drain terminal of the sense MOSFET M2. The second terminal, B, of the current conveyor circuit is connected to the drain terminal of the power MOSFET M1. The third terminal, C, of the current conveyor circuit is connected to ground, in the case of a PMOS type power transistor, or to the upper supply voltage rail, in the case of an NMOS type power transistor. The current conveyor circuit is used to transfer the voltage at the drain terminal of the power MOSFET to the drain terminal of the sense MOSFET. At the same time, it causes a current, equal to the current flowing in the drain terminal of the sense MOSFET, to flow in the other terminal, B, of the current conveyor circuit, thus forcing that current to flow into the drain terminal of the power MOSFET. The current that flows in the sense MOSFET is, generally, much smaller than the current flowing in the power MOSFET by a factor which is determined, essentially, by the scale ratio between the sense MOSFET and the power MOSFET. As a first approximation, the scale ratio is given by the W/L ratios of these two devices, where W is the channel width and L is the channel length. Because this factor is usually very large, the supplementary loading of the power MOSFET drain terminal with a much smaller current, is of no practical effect. As disclosed in this patent, the current conveyor circuit comprises two bipolar transistors and a MOSFET current mirror, which is referred to ground. Using the reference side of this current mirror (device M3 in FIG. 2), another current, substantially proportional to the current flowing in the power MOSFET, can be derived, by using another current mirror circuit, consisting of transistors M3 and M5 in FIG. 2. The current thus obtained can be used to monitor the power MOSFET current and may be scaled up or down, as needed. The advantage of the circuit described in this prior art reference, over the previous one, is that the drain voltage is essentially the same for both the power FET and the sense FET. The voltage at node A equals the voltage at the base of transistor Q2, plus the base-emitter voltage of transistor Q2. The voltage at the base of transistor Q2 equals the voltage at node B, minus the base-emitter voltage of transistor Q1. Transistors Q1 and Q2 have essentially the same collector current, due to the current mirror M3–M4. This makes their base-emitter voltages equal and leads to equal voltages at nodes A and B, in FIG. 2. Hence, the power FET and the sense FET operate at essentially equal drain-to-source voltages. This improves M1–M2 current mirror performance, which is of increasing importance, as the operating drain-to-source voltage becomes smaller.

The two bipolar transistors included in the current conveyor circuit of U.S. Pat. No. 5,867,015 must be fully floating. That is, they must have all terminals uncommitted. Because the vast majority of CMOS processes do not offer bipolar transistors with uncommitted terminals, and because simply replacing the bipolar devices in the current conveyor circuit disclosed in this reference with appropriate MOSFET devices leads to non-functional circuitry, a novel solution is proposed in accordance with the present invention.

Generally, and in accordance with one embodiment of the present invention, a circuit for parallel sensing of the current in a FET, referred to as a power FET, includes a sense FET and a current conveyor circuit employing exclusively FET devices. All FET devices may be MOSFET devices or JFET devices. The sense FET and the power FET have their gate terminals connected together and their source terminals connected together. This allows the implementation of the circuits of the present invention in integrated circuits realized in CMOS processes, without the need for bipolar devices. The circuits of the present invention may also be employed in situations where JFET devices are provided in the process, as well as in discrete component implementations.

DETAILED DESCRIPTION OF THE PREFERRED EMBODIMENTS

Figure 1:
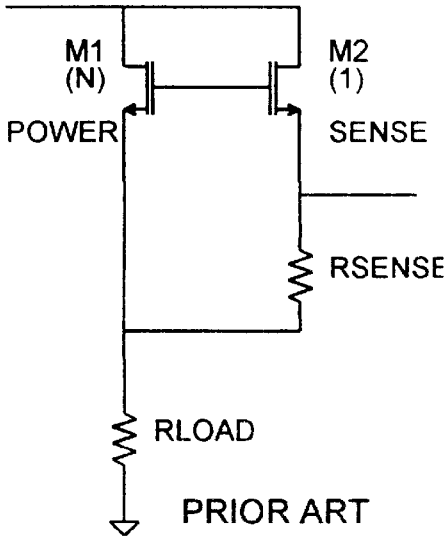
FIG. 1 illustrates a prior art circuit shown and described in U.S. Pat. No. 5,272,392 for parallel sensing the current in a power MOSFET device.
Figure 2:
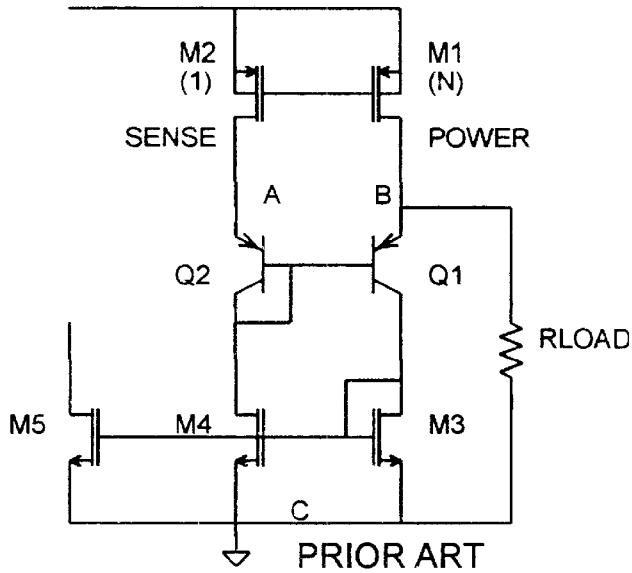
FIG. 2 illustrates a prior art circuit shown and described in U.S. Pat. No. 5,867,015 for parallel sensing the current in a power MOSFET device.
Figure 3:
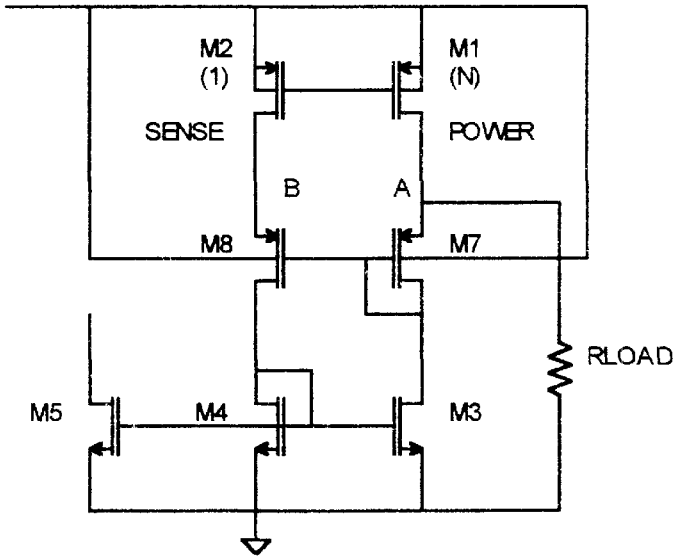
FIG. 3 is a detailed diagram of a current sensing circuit employing a P-type power MOSFET device and a ground referenced current conveyor circuit, in accordance with the present invention.

Referring now to FIG. 3, there is shown a current sensing circuit in accordance with one embodiment of the present invention that is employed in a PMOS power FET application, although it may also be employed in circuits using JFET devices and discrete FET devices. In this circuit, the current of a power FET M1 is monitored by FET M2. A FET-only current conveyor circuit consists of components M3, M4, M7, M8.

The gate terminal of power FET M1 is connected to the gate terminal of sense FET M2. The source terminal of power FET M1 is connected to the source terminal of sense FET M2. The drain terminal of power FET M1 is connected to a load Rload. The drain terminal of FET M1 is also connected to a reference terminal A of the current conveyor circuit. The drain terminal of the sense FET M2 is connected to a mirror terminal B of the current conveyor circuit. The current conveyor circuit is referenced to ground.

The role of the current conveyor circuit is to transfer voltage from its reference terminal to its mirror terminal. At the same time, the current flowing into its mirror terminal is mirrored at the reference terminal. The current conveyor circuit transfers the drain voltage of the power FET M1 to the drain terminal of the sense FET M2. The current conveyor circuit ensures that both the power FET M1 and the sense FET M2 operate at the same source-to-drain voltage. This is crucial for the accuracy of the current mirror consisting of power FET M1 and sense FET M2. At low source-to-drain voltages, the power FET M1 and sense FET M2 are near saturation or saturated, and the current flowing through them depends heavily on the source-to-drain voltage. Hence, it is mandatory for this voltage to be accurately transferred from the power FET M1 to the sense FET M2. Otherwise, the current mirror, represented by the power FET M1 and the sense FET M2, is very inaccurate. Many power FET devices, used in low dropout applications, or used as switches, etc., operate under low and very low source-to-drain voltage conditions.

Devices M3 and M4 of FIG. 3 act as a current mirror and force equal currents to flow in devices M7 and M8. There is a source-to-gate voltage drop from the drain of power FET M1 to the gate of device M7. There is a source-to-gate voltage increase from the gate of device M7 to the drain of the sense FET M2. Because the currents flowing into devices M7 and M8 are equal and they are the same type devices, the source-to-gate voltage is the same for each of them. This makes the drain voltage of the sense FET M2 equal to the drain voltage at the drain of the power FET M1. Thus, the power FET M1 and the sense FET M2 operate at the same source-to-drain voltage. Each of their respective terminals is operating at the same voltage. This allows accurate current mirroring between devices M1 and M2, which is an important aspect of the present invention. The ratio between the sizes of power FET M1 and sense FET M2 is selected to achieve a desired current magnitude, which is not required to be an integer. However, some semiconductor fabrication processes yield a more controllable current ratio if the size ratio of power FET M1 to sense FET M2 is an integer. For instance, the power FET M1 and the sense FET M2 can both be implemented with the same type of repetitive structures, more numerous in the case of the power FET M1 than in the case of sense FET M2.

The current flowing in sense transistor M2 of FIG. 3 is proportional to the current flowing in power FET M1. The same current that flows into sense FET M2, flows into the current mirror consisting of devices M3, M4 of the current conveyor circuit. The diode connected transistor M4 may be used as a reference for yet another current mirror, consisting of devices M4 and M5 of FIG. 3. The current flowing into the mirror device M4 is proportional to the current flowing into the current mirror of the current conveyor, which is equal to the current flowing in the sense transistor M2, which, in turn, is proportional to the current flowing in the power FET M1. Hence, the current flowing in device M5 is proportional to the current flowing in the power FET M1. The current flowing in device M5 may be used to monitor the current in power FET M1 and for signal processing of that current.

The proportionality factor between the current in power FET M1, to be monitored, and the monitoring signal, which is the current in device M5 of FIG. 3, can be adjusted by changing the ratio of the M1–M2 current mirror and/or the ratio of the M4–M5 current mirror. Furthermore, the current in device M5 can be mirrored again, with respect to an upper voltage rail, and presented to a subsequent circuit as a current source, instead of a current sink. The process can be repeated as needed, allowing arbitrary scaling of the monitoring current, and its arbitrary referencing, either as a current source or a current sink, to an arbitrary voltage rail.

Figure 4:
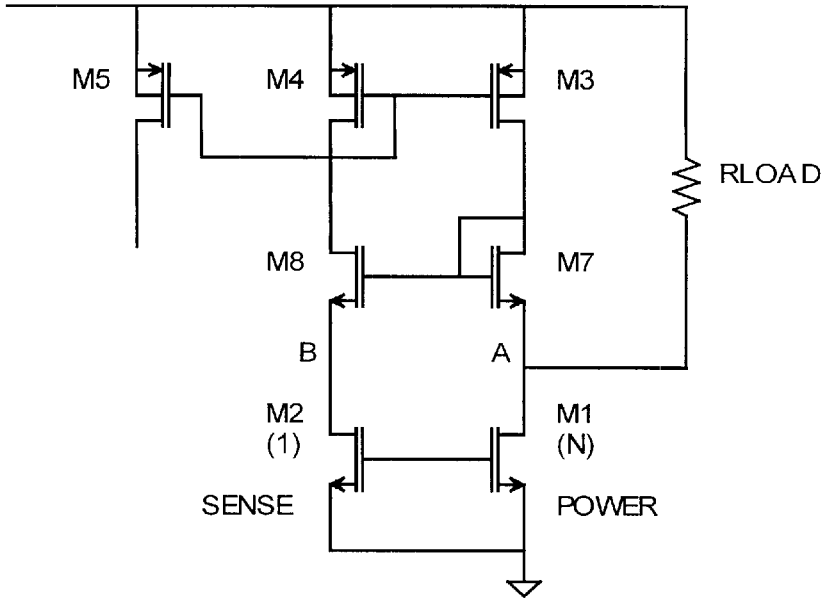
FIG. 4 is a detailed diagram of a current sensing circuit employing an N-type power MOSFET device and a positive rail referenced current conveyor circuit, in accordance with the present invention.

Referring now to FIG. 4, there is shown a circuit embodiment of the present invention in which the power device M1 is an NMOS-type FET. This circuit operates the same way as the circuit of FIG. 3, described above, but the voltage signs and polarities are adjusted for this application; that is, NMOS devices are replaced by PMOS devices and vice-versa. Devices having like functions are designated by the same reference numeral in both FIGS. 3 and 4. M1 is the power FET, and M2 is the sense FET, etc.

Figure 5:
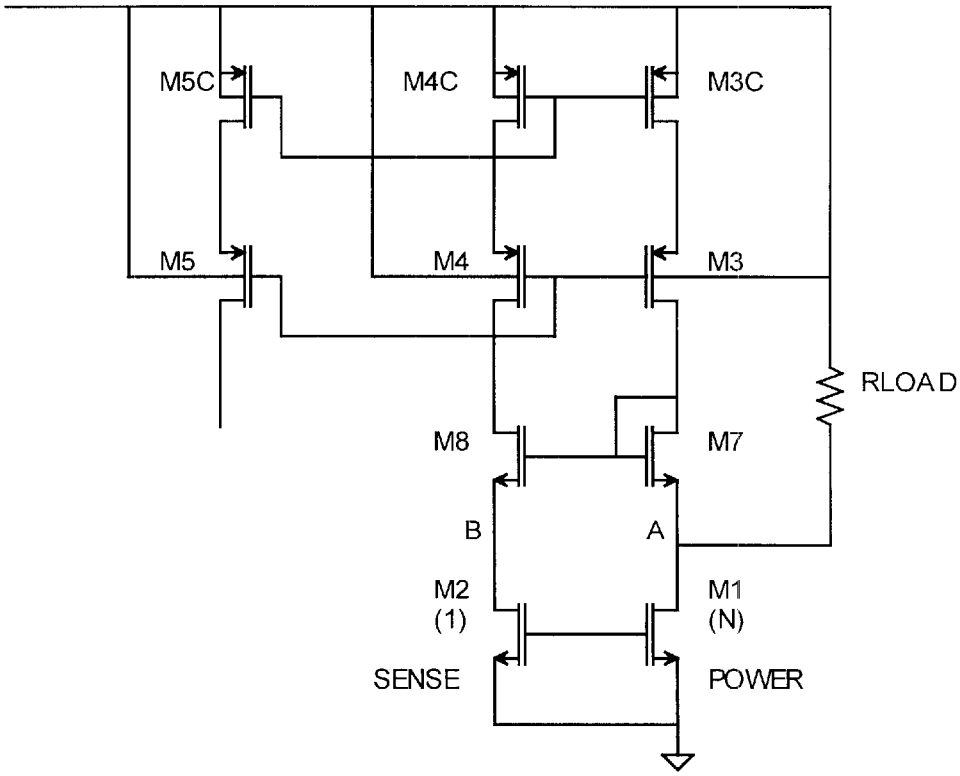
FIG. 5 is a detailed diagram of a current sensing circuit employing an N-type power MOSFET device, a positive rail referenced current conveyor circuit, and a cascoded current mirror, in accordance with the present invention.

Referring now to FIG. 5, there is shown a circuit embodiment of the present invention in which, like the circuit of FIG. 4, the power device M1 is an NMOS power FET. The circuit operates the same way as the circuit of FIG. 4, described above, except for the current mirror, which is now implemented by using a cascoded circuit consisting of devices M3, M3*c*, M4, M4*c*. The output current for the circuit is also obtained from the cascoded devices M5, M5*c*. The output current may also be generated without a cascoded arrangement, by eliminating device M5 and using only device M5*c*. The cascoded current mirror within the current conveyor circuit is more important, as it assures higher accuracy of the currents flowing through devices M7 and M8, which, in turn, improves the matching of their gate-to-source voltages. This is important for the accurate biasing of sense FET M2, in particular, its drain voltage, as the sense FET M2 mirrors the current, scaled down, of power FET M1

It should be understood that the current conveyor circuits of the present invention have a topology that is different from the topology of the current conveyor described in U.S. Pat. No. 5,867,015.

Referring again to FIG. 3, it is possible to use the same circuit for the case of the power FET M1 being a discrete device. The only change from the operation described above consists in the fact that the current mirroring ratio of the M1–M2 current mirror must be evaluated, depending upon device M2 also being a discrete device, or being part of an integrated circuit. Furthermore, the same considerations also apply to the case of hybrid circuits, where FETs appear as discrete devices. The principle disclosed in the present invention can be equally applied to integrated circuits, to hybrid circuits, to discrete circuits, or to a mix of them.

I claim:

1. A circuit for parallel sensing current in a power field effect transistor (FET) of a particular conductivity type, the circuit comprising:

a sense field effect transistor (FET) of the same conductivity type as said power field effect transistor (FET), a gate terminal of said sense field effect transistor (FET) being connected to a gate terminal of said power field effect transistor (FET) and a source terminal of said sense field effect transistor (FET) being connected to a source terminal of said power field effect transistor (FET);

a current conveyor circuit employing exclusively field effect transistors (FETs), said current conveyor circuit having a reference input terminal and a mirror output terminal, said reference input terminal being connected to a drain terminal of said power field effect transistor (FET) and said mirror output terminal being connected to a drain terminal of said sense field effect transistor (FET); and one or more cascode current mirror circuits employing exclusively field effect transistors (FETs), said one or more cascode current mirror circuits utilizing a current flowing in said current conveyor circuit as a reference current.

2. A circuit as in claim 1, wherein said power field effect transistor (FET) and said sense field effect transistor (FET) each comprise a junction field effect transistor (JFET).

3. A circuit as in claim wherein said power field effect transistor (FET) and said sense field effect transistor (FET) each comprise a metal oxide semiconductor field effect transistor (MOSFET).

4. A circuit as in claim 1, wherein said power field effect transistor (FET) is located separate from said sense field effect transistor (FET), said current conveyor circuit, and said one or more cascode current mirror circuits.

* * * * *